US007476821B1

(12) United States Patent
Knuppel

(10) Patent No.: US 7,476,821 B1
(45) Date of Patent: Jan. 13, 2009

(54) TRIGGER MECHANISM

(75) Inventor: Stefan Knuppel, Hong Kong (CN)

(73) Assignee: Defond Components Limited, Chaiwan, Hong Kong SAR (CN)

( * ) Notice: Subject to any disclaimer, the term of this patent is extended or adjusted under 35 U.S.C. 154(b) by 0 days.

(21) Appl. No.: 11/782,358

(22) Filed: Jul. 24, 2007

(51) Int. Cl.
*H01H 9/06* (2006.01)

(52) U.S. Cl. ..... 200/332.2; 200/522; 200/43.17

(58) Field of Classification Search ..... 200/43.16, 200/43.17, 61.85, 61.86, 522, 318, 318.1, 200/321, 322, 329, 332.1, 332.2
See application file for complete search history.

(56) References Cited

U.S. PATENT DOCUMENTS 3,461,556 A * 8/1969 Chambers ..... 30/277.4
3,603,757 A * 9/1971 Sahrbacker ..... 200/522
3,755,640 A * 8/1973 Kaman et al. ..... 200/522
3,869,591 A * 3/1975 Piber ..... 200/321
4,553,005 A * 11/1985 Glenn ..... 200/522
4,572,997 A * 2/1986 Yamanobe et al. ..... 388/840
6,104,105 A * 8/2000 Schaeffeler et al. ..... 307/125
6,274,828 B1 * 8/2001 Chu ..... 200/43.17
6,555,773 B1 * 4/2003 Broghammer et al. ... 200/61.85
6,794,594 B2 * 9/2004 Ching ..... 200/522
6,861,598 B2 * 3/2005 Bascom et al. ..... 200/43.17

* cited by examiner

*Primary Examiner*—Michael A Friedhofer
(74) *Attorney, Agent, or Firm*—Leydig, Voit & Mayer, Ltd.

(57) ABSTRACT

A trigger mechanism for an electric power tool, comprises a spring-loaded trigger movable between an foremost position and an rearmost position, an adjuster for adjusting the rearmost position, an electrical switch arranged for closing by the trigger while the trigger is in an intermediate position, and a variable resistor arranged for operation by the trigger while the trigger is in an intermediate position to provide a resistance having a value dependent upon the position of the trigger. A locking device is included for locking the trigger near the rearmost position, and which is movable in opposite directions and arranged to lock the trigger near the rearmost position when the locking device is moved in either one of opposite directions.

17 Claims, 5 Drawing Sheets

TRIGGER MECHANISM

The present invention relates to a trigger mechanism for an electric power tool, particularly but not exclusively, of the type intended for use in a hand-held power tool such as an electric drill, jigsaw or rotary driving tool.

BACKGROUND OF THE INVENTION

Trigger mechanisms for electric power tools are known to have a lock-on function. These mechanisms typically include a pushbutton enabling the trigger to be locked down in the switched on position, so that there is no need for a user to keep pulling the trigger.

It is an object of the present invention to provide a new or otherwise improved trigger mechanism of the type concerned, which is more convenient to use.

SUMMARY OF THE INVENTION

According to the invention, there is provided a trigger mechanism for an electric power tool, comprising:

a housing;

a trigger supported for movement relative to the housing between an foremost position and an rearmost position, the trigger being resiliently biased by a spring to return towards the foremost position, the rearmost position being adjustable;

an adjuster for adjusting the rearmost position of the trigger;

an electrical switch arranged for operation by the trigger while the trigger is in an intermediate position to close an electrical circuit;

a variable circuit element arranged for operation by the trigger while the trigger is in an intermediate position to provide a parameter of a valve dependent upon the position of the trigger; and a locking device associated with the housing for locking the trigger near the rearmost position, the locking device being movable in opposite directions and arranged to lock the trigger near the rearmost position when the locking device is moved in each one of said opposite directions.

Preferably, the locking device is movable along a linear path in said opposite directions to lock the trigger.

More preferably, the trigger is mounted at the front of the housing, the housing having opposite left and right sides about the trigger, and the locking device is movable linearly in opposite left and right directions corresponding to the left and right sides of the housing.

More preferably, the locking device has a pair of opposite ends, by each of which the locking device can be pressed to move in the opposite direction.

It is preferred that the locking device is resiliently biased by a spring to stay normally in a central position from which the locking device is movable in said opposite directions to lock the trigger.

In a preferred embodiment, the adjuster comprises a stop that is mechanically associated with the trigger for simultaneous movement therewith and for engaging an abutment to stop the trigger at the rearmost position, the stop being adjustable in its position relative to the trigger such that the rearmost position of the trigger can be adjusted.

More preferably, the adjuster includes a screw-threaded shaft mechanically associated with the stop, the shaft being rotatable about its axis to adjust the position of the stop relative to the trigger.

Further more preferably, the stop is in screw-threaded engagement around the shaft for sliding along the shaft when the shaft is rotated.

Further more preferably, the adjuster includes a dial connected with the shaft for rotating the shaft, the dial being located at the trigger.

In a preferred embodiment, the locking device has a pair of detents for individual engagement with a part associated with the trigger to lock the trigger, each detent being shaped to maintain the engagement under the action of the spring upon the trigger.

More preferably, each detent has an internal corner for engaging the part associated with the trigger on adjacent sides thereof so as to stop return of the trigger and release of the locking device in the opposite direction.

It is preferred that the locking device has a part for engagement with the stop to lock the trigger.

It is further preferred that the part of the locking device has a pair of detents for individual engagement with the stop to lock the trigger, each detent being shaped to maintain the engagement under the action of the spring upon the trigger.

It is yet further preferred that each detent has an internal corner for engaging the stop on adjacent sides thereof so as to stop return of the trigger and release of the locking device in the opposite direction.

In a preferred embodiment, the locking device has a first member movable in said opposite directions and a second member for engaging to lock the trigger, the first and second members being distinct parts.

More preferably, the first member of the locking device is movable along a linear path in said opposite directions, and the second member is pivotable by the first member upon movement to lock the trigger.

Further more preferably, the second member of the locking device has a bifurcate end for engaging a part associated with the trigger, the bifurcate end having a gap aligned with the said part when the locking device is in a central position from which from which the locking device is movable in said opposite directions.

It is preferred that the locking device has a part for manual operation which is located at a position above and behind the trigger.

It is preferred that the opposite ends of the locking device are located at a position above and behind the trigger.

BRIEF DESCRIPTION OF DRAWINGS

The invention will now be more particularly described, by way of example only, with reference to the accompanying drawings, in which.

DETAIL DESCRIPTION OF PREFERRED EMBODIMENT

Figure 1:
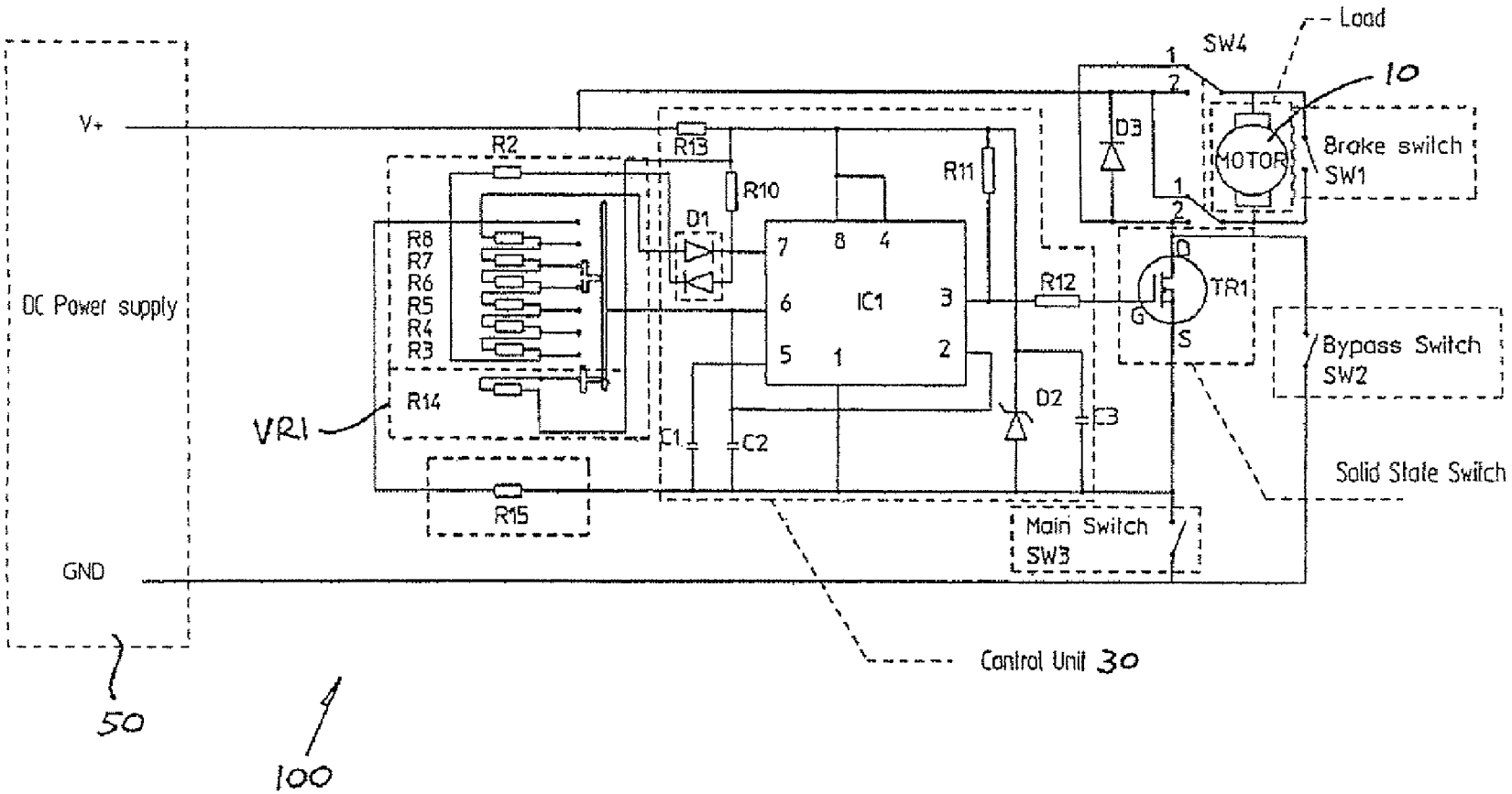
FIG. 1 is a schematic circuit diagram of an electric power tool incorporating an embodiment of a trigger mechanism in accordance with the invention.

Referring initially to FIG. 1 of the drawings, there is illustrated an electrical circuit for an electric drill, which incorporates a trigger mechanism 100 embodying the invention for controlling the operation of the drill. The drill is driven by an electric motor 10 (i.e. the load) which is powered by a rechargeable DC battery pack 50 (or the AC mains power source in a different embodiment) and whose operation including speed is controlled using a pull-trigger 120 as part of the trigger mechanism 100.

The trigger mechanism 100 employs an electronic operating circuit that includes a solid-state switch such as a MOSFET transistor TR1 and a mechanical main switch SW3 which are connected in series with each other between the motor 10 and the battery pack 50 for controlling the power supplied to the motor 10. While the main switch SW3 is closed, the transistor TR1 switches on and off repeatedly to deliver an adjustable pulsating DC current via the main switch SW3 to the motor 10 for rotation at a desired speed/torque.

A bypass switch SW2 is preferably connected in parallel with the transistor TR1 and the main switch SW3 for delivering uninterruptedly the full non-pulsating DC current from the battery pack 50 to the motor 10 for maximum speed/torque. A brake switch SW1 is preferably connected in parallel with the motor 10 for speedy, regenerative braking. A reverse circuit, formed by a 2P-2T switch SW4 and a diode D3, may be used connecting the transistor TR1 to the motor 10 for reversing the current driving the motor 10 and hence its direction or rotation.

The trigger mechanism 100 includes a control unit 30 that is built based on an integrated circuit control chip IC1 for generating a control signal at a predetermined frequency of several 100 Hz up to 10 kHz to turn on and off the transistor TR1 for operation at that frequency. The control chip IC1 has an output pin 3 connected to the transistor TR1, a pair of input pins 2 and 6, and a discharge pin 7 for a capacitor C2 connected to both input pins 2 and 6.

Also included in the trigger mechanism 100 is a variable resistor assembly VR1 which is mechanically associated with the trigger mechanism 100 for operation thereby and is connected to both input pins 2 and 6 of the control chip IC1. The assembly VR1 adjusts the pulse width or mark-to-space ratio of the control signal at the output pin 3 of the control chip IC1 and in turn the rms value of the pulsating DC current at the output of the transistor TR1 for driving the motor 10 at a corresponding speed/torque.

Figure 4:
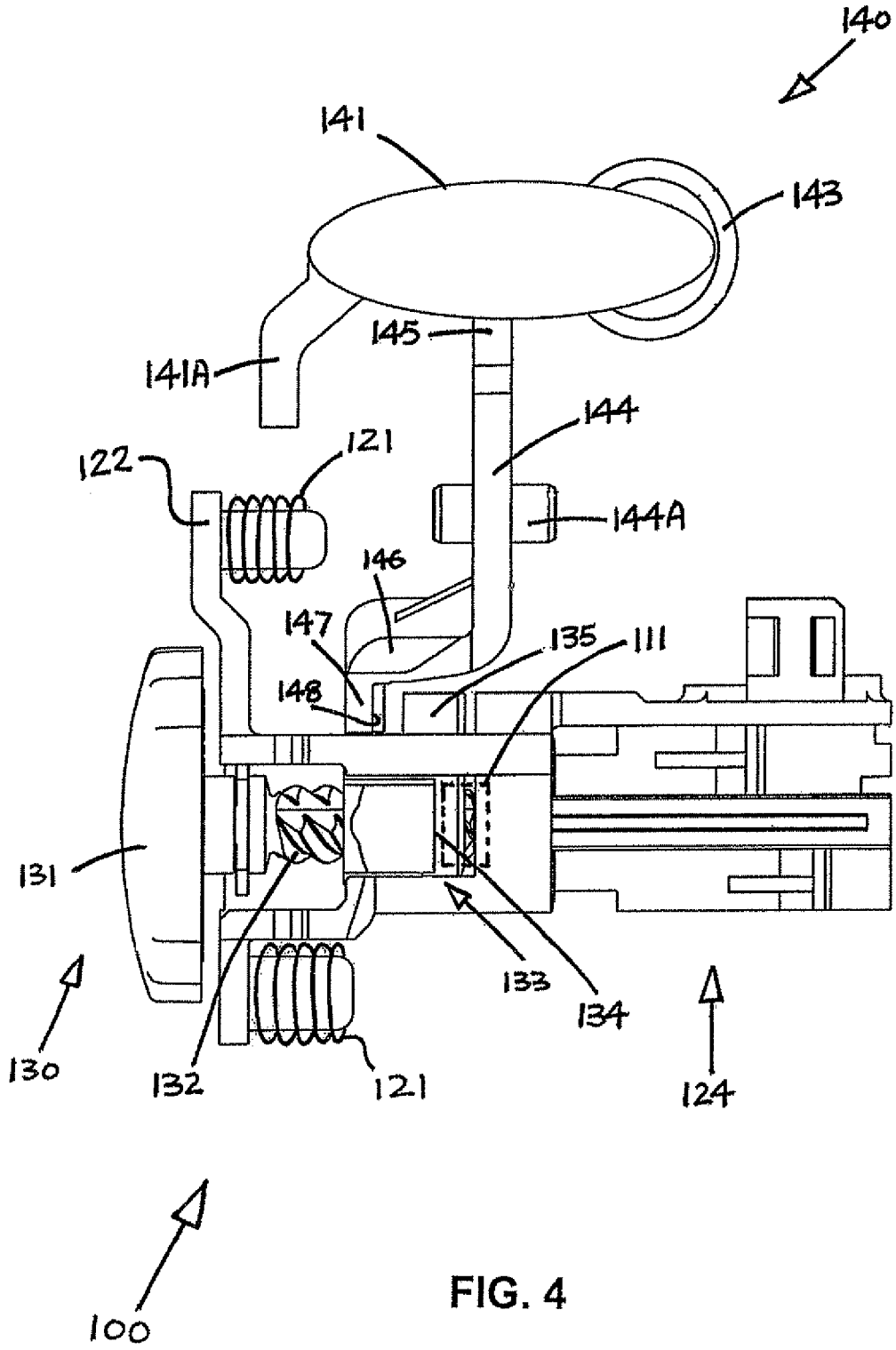
FIG. 4 is a side view of the trigger mechanism of FIG. 3.
Figure 5:
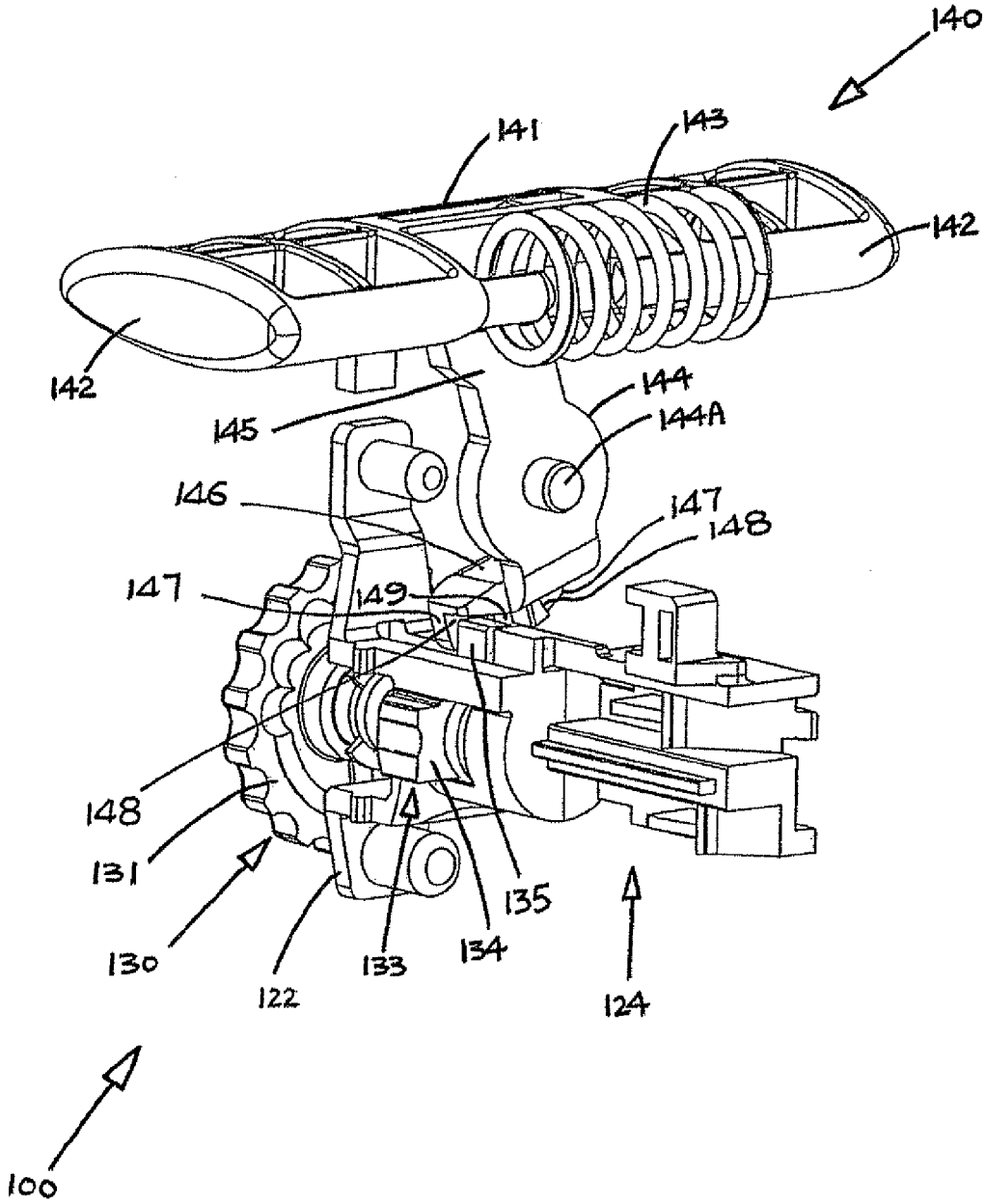
FIG. 5 is a rear perspective view of the trigger mechanism of FIG. 3, in which the pull-trigger has been depressed and the locking device is operated to lock the pull-trigger in the depressed position.

Reference is also made to FIGS. 2 to 5 of the drawings. The trigger mechanism 100 has a housing 110 that supports, at its front, the pull-trigger 120 for horizontal linear sliding movement relative to the housing 110 between a foremost position (FIG. 3) and a rearmost position (FIG. 4). The pull-trigger 120 has a horizontal stem 124 that fits rearwardly into the housing 110. The pull-trigger 120 is mounted on an internal support 122 and is resiliently biased by two coil springs 121 acting upon the support structure 122 to slide outwards, upon return, into or towards its foremost position. Whilst the foremost position of the pull-trigger 120 is fixed, its rearmost position can be adjusted by means of a built-in adjuster 130.

The trigger stem 123 is a hollow structure which is shaped or configured externally to operate the three mechanical switches SW1 to SW3 (i.e. brake, bypass and main switches) as well as the variable resistor assembly VR1, or to mount suitable actuating means for operating such control components.

Immediate upon departure of the pull-trigger 120 from its foremost position, the stem 123 closes the main switch SW3 and hence an electrical circuit including the motor 10 to permit control of the motor 10 by the transistor TR1. Upon full depression of the pull-trigger 120 to its rearmost position, the stem 123 closes the bypass switch SW2 to dodge the transistor TR1 such that uninterrupted full DC current can flow to the motor 10. As soon as the pull-trigger 120 returns to its foremost position upon release, the stem 123 closes the brake switch SW1 to short-circuit the motor 10 for immediate braking.

While the pull-trigger 120 is at an intermediate position between its foremost and rearward positions, the stem 123 adjusts the variable resistor assembly VR1 to provide a resistance of a valve that is dependent upon the position of the pull-trigger 120, thereby controlling the motor 10 to run at a corresponding speed/torque via the control chip IC1 and the transistor TR1. The more the pull-trigger 120 is depressed (i.e. nearer the rearmost position), the faster the motor 10 runs, or the larger the on-load torque is.

The adjuster 130 serves to limit the extent to which the pull-trigger 120 can be depressed, thereby restricting the speed/torque of the motor 10.

The adjuster 130 is in the form of a vertical dial wheel 131 which fits in a front recess of the pull-trigger 120 and has a horizontal central shaft 132 extending to the rear, the shaft 132 being screw-threaded. An annular stop 133, bearing screw threads internally, is disposed around the shaft 132 through screw-threaded engagement such that the stop 133 slides along the shaft 132 as the latter is rotated. The shaft 132 and stop 133 interact like an auger acting upon a nut around it.

With the dial wheel 131 lying on the pull-trigger 120, the wheel's shaft 132 extends within the trigger's hollow stem 124, supporting the stop 133 in the stem 124. The stop 133 is therefore mechanically associated with the pull-trigger 120 for simultaneous movement therewith. The dial wheel 131 and hence its shaft 132 can only rotate about their common central axis relative to the pull-trigger 120. Turning of the dial wheel 131 rotates the shaft 132 to in turn slide the stop 133 forward or backward along the stem 124, whereby the stop 133 can be located at an adjustable position relative to the stem 124.

The stop 133 has a side protrusion 134 and a top protrusion 135, both of which stick out through respective slots along the stem 124. An internal abutment 111 of the housing 110 stands in the way of the side protrusion 134 for engagement by the side protrusion 134 as the stem 124 slides rearwards so as to stop further depression of the pull-trigger 120, thereby stopping the pull-trigger 120 at its rearmost position. Thus, by changing the position of the stop 133 on the trigger stem 124, the rearmost position of the pull-trigger 120 can be adjusted.

The top protrusion 135 is in the form of an upright small tab 135 that lies in the same vertical plane as the trigger stem 124.

The trigger mechanism 100 includes a locking device 140 mounted by the housing 110 for locking the pull-trigger 120 near, or close to, its rearmost position, thereby locking on to keep the motor 10 running. The locking device 140 is formed by two distinct parts, i.e. a horizontal oblong slider 141 for operation by a user and a vertical lever 144 coupled with the slider 141 for engaging the pull-trigger 120 internally to hold the same in position.

The slider 141, which have a pair of symmetrical left and right ends 142, extends horizontally across an upper end of the housing 110, through a pair of aligned left and right side apertures thereof. It is a bi-directional slider that is linearly slidable, to a limited extent, in opposite left and right directions. A coil spring 143 in the middle resiliently biases the bi-directional slider 141 to stay normally in a central position relative to the housing 110, with its opposite ends 142 protruding for depression to slide the overall slider 141 in the opposite direction from the central position.

Figure 2:
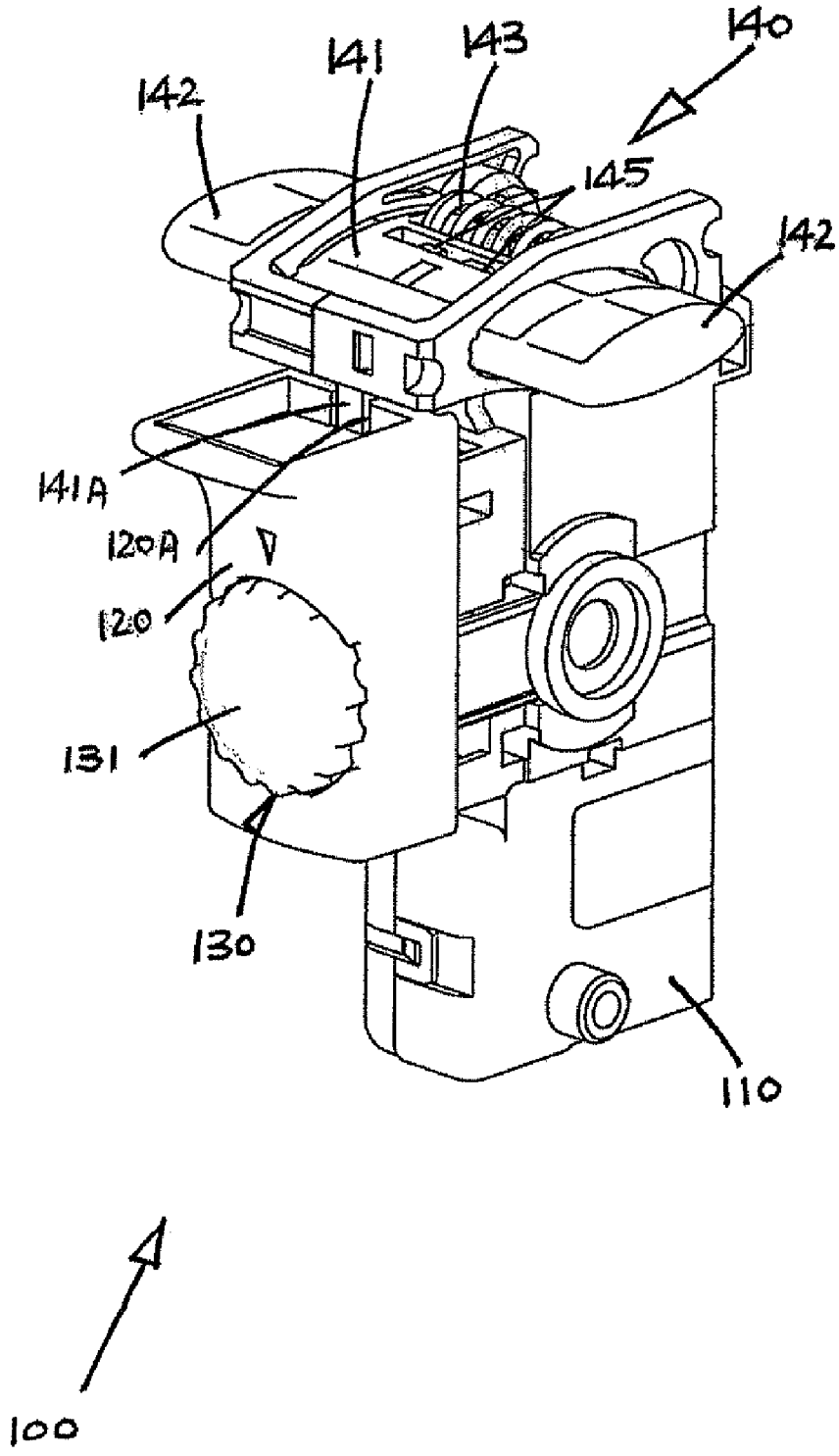
FIG. 2 is a front perspective view of the trigger mechanism of FIG. 1, including a pull-trigger and a locking device for locking the pull-trigger in a depressed position.
Figure 3:
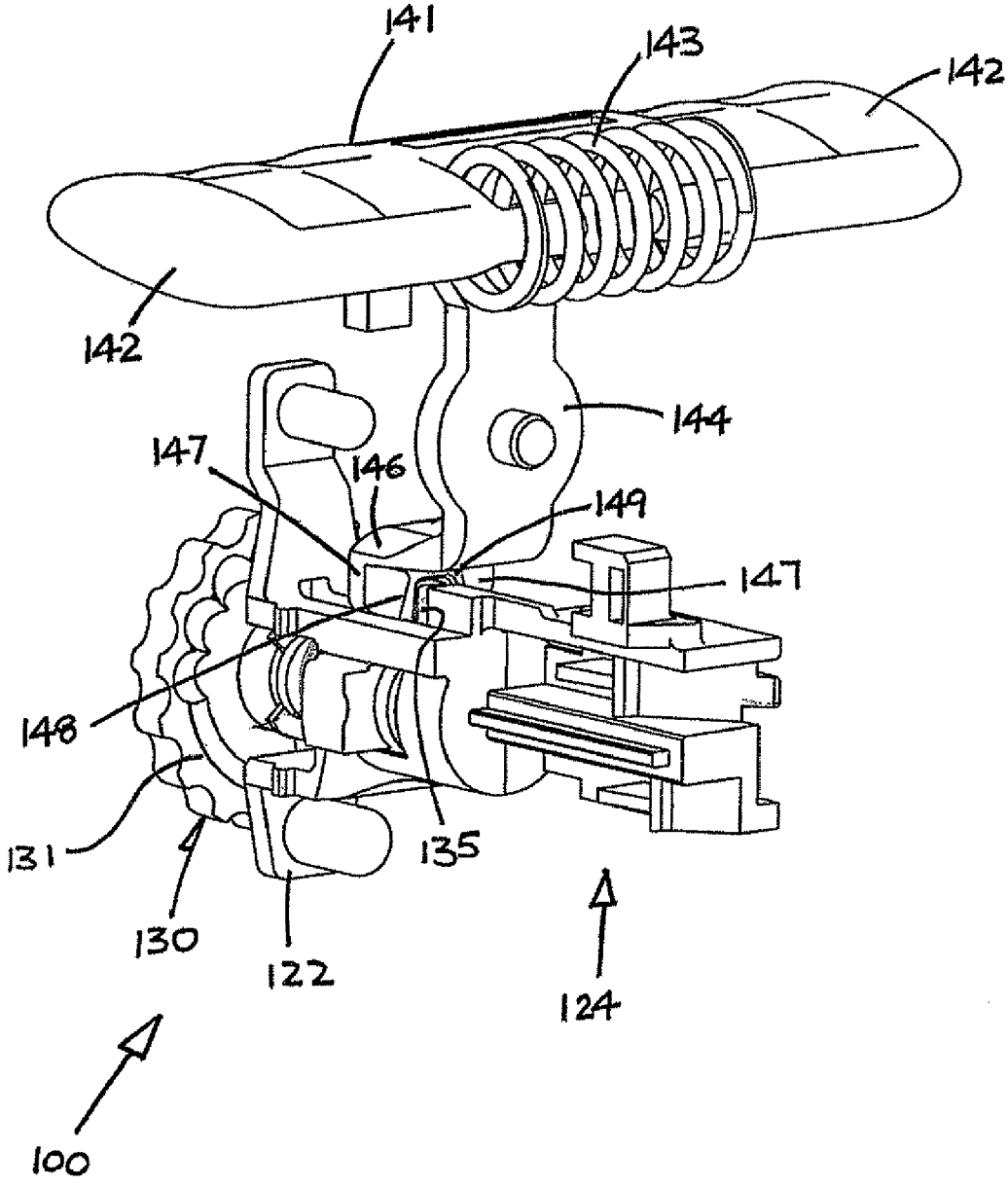
FIG. 3 is a rear perspective view of the trigger mechanism of FIG. 2.

The slider 141, with its opposite ends 142, is located at a position above and behind the pull-trigger 120, as shown in FIG. 2. With this arrangement, for a right-handed user, the left end 142 of the slider 141 can conveniently be pressed by his/her thumb, and the right end 141 by the index finger.

The lever 144 has an upper end 145 and a lower end 146, and includes a central horizontal pivot pin 144A about which it is supported and hinged for pivotal movement in opposite directions. The upper end 145 is bifurcate and engages a central beam of the slider 141 such that the lever 144 is pivotable by the slider 141 upon sliding. The lever 144 assumes a vertical orientation when the slider 141 is in its central position, being resiliently biased thereto under the action of the spring 143.

The lower end 146 is likewise bifurcate, having a pair of symmetrical prongs 147 that define a narrow central gap 149 between them. The prongs 147 have respective L-shaped cross-sections arranged back-to-back, each defining a detent 148 in the form of a right-angled internal corner. The two detents 148 face laterally outwardly in opposite directions and both to the rear in the direction of movement of the pull-trigger 120.

The lower end 146 is placed close to the top protrusion or tab 135 of the stop 133 on the trigger stem 124, whereby its two prongs 147 can selectively engage the protrusion 135 by means of their detents 148. The gap 149 is aligned with the tab 135 when the lever 144 is in its vertical orientation, such that the tab 135 can go past the prongs 147 through the gap 149 therebetween, whereby the trigger stem 124 or the overall pull-trigger 120 can be pulled rearwards without obstruction.

This is an inactive state of the locking device 140, in which the pull-trigger 120 can be pulled and let go to return anytime as desired, as would have been done during normal use of the drill.

The locking device 140 can be operated conveniently on either left or right side of the trigger mechanism 100, or the drill. However, it cannot be operated before the pull-trigger 120 is pulled, by reason of a central front beak 141A of the slider 141 being trapped in a top rear notch 120A of the pull-trigger 120 (FIG. 2).

To use the drill, the pull-trigger 120 is pulled to switch on the motor 10. As the pull-trigger 120 is pulled, its stem 124 slides back therewith and so does the tab 135 of the stop 133, which then slips past the prongs 147 of the lever 144.

To lock the drill on, the slider 141 is pressed at either end 142 (on either side) and this swings the lever 144 in the opposite direction. While the slider 141 is being displaced, the pull-trigger 120 is released and it will then immediately slide forwards under the action of the springs 121. The pull-trigger 120 can only go for a very short distance before the tab 135 on its stem 124 hits the prong 147 that has been swung in the way, and then the slider 141 should be released.

Under the action of the spring 143 upon the slider 141, the lever 144 bears the relevant prong 147 against the tab 135, with the prong's detent 148 arresting the tab 135. By reason of its L-shaped internal corner, the detent 148 maintains engagement with the tab 135, on adjacent sides thereof, so as to stop the tab 135 in the direction of movement of the pull-trigger 120 against its return and to hold the lever 144 against swinging back under the action of the spring 143.

To release the locking device 140, one only has to press the pull-trigger 120 briefly. Upon slight sliding back, the tab 135 disengages from the detent 148, whereupon the lever 144 is instantly swung back by the spring 135, re-aligning the gap 149 with the tab 135. With the tab 135 no longer being obstructed, the stem 124 and hence the pull-trigger 120 can then return to its foremost position, switching off the motor 10.

The locking device 140 can be operated conveniently on either left or right side of the trigger mechanism 100, or the drill. This is particularly advantageous when the drill is held by the left hand.

The invention has been given by way of example only, and various modifications and/or variations to the described embodiment may be made by persons skilled in the art without departing from the scope of the invention as specified in the accompanying claims. For example, the locking device may employ a hinged or pivoted member for operation, instead of the sliding member 141 as described above.

The invention claimed is:

1. A trigger mechanism for an electric power tool, comprising:

a housing;

a first spring;

a trigger supported for movement relative to the housing between a foremost position and a rearmost position, the trigger being resiliently biased by a first spring towards the foremost position, and the rearmost position being adjustable;

an adjuster for adjusting the rearmost position of the trigger;

an electrical switch arranged for operation by the trigger, while the trigger is in an intermediate position, between the foremost and rearmost positions, and closing an electrical circuit;

a variable circuit element arranged for operation by the trigger, while the trigger is in the intermediate position, to provide a parameter having a value dependent upon position of the trigger; and a locking device associated with the housing for locking the trigger near the rearmost position, movable in opposite directions and arranged to lock the trigger near the rearmost position when the locking device is moved in either of the opposite directions, and including distinct first and second members, the first member being movable in the opposite directions and the second member engaging to lock the trigger.

2. The trigger mechanism as claimed in claim 1, wherein the trigger is mounted at a front of the housing, the housing has opposite first and second sides on opposite sides of the trigger, and the first member is movable linearly in opposite first and second directions corresponding to the first and second sides of the housing.

3. The trigger mechanism as claimed in claim 1, wherein the first member has a pair of opposite ends, and each of the ends is pressed to move the first member in opposite directions.

4. The trigger mechanism as claimed in claim 3, wherein the opposite ends of the first member are located at a position above and behind the trigger.

5. The trigger mechanism as claimed in claim 1 including a second spring, wherein the first member is resiliently biased by the second spring toward a normal, central position from which the first member is movable in the opposite directions to lock the trigger.

6. The trigger mechanism as claimed in claim 1, wherein the adjuster comprises a stop that is mechanically associated with the trigger for simultaneous movement with the trigger and for engaging an abutment to stop the trigger at the rearmost position, the stop being adjustable in position relative to the trigger such that the rearmost position of the trigger can be adjusted.

7. The trigger mechanism as claimed in claim 6, wherein the adjuster includes a screw-threaded shaft mechanically associated with the stop, the shaft being rotatable about an axis to adjust the position of the stop relative to the trigger.

8. The trigger mechanism as claimed in claim 7, wherein the stop is in screw-threaded engagement around the shaft for sliding along the shaft when the shaft is rotated.

9. The trigger mechanism as claimed in claim 7, wherein the adjuster includes a dial connected with the shaft for rotating the shaft, the dial being located at the trigger.

10. The trigger mechanism as claimed in claim 6, wherein the second member has a part for engagement with the stop to lock the trigger.

11. The trigger mechanism as claimed in claim 10, wherein the part of the second member has a pair of detents for individual engagement with the stop to lock the trigger, each detent being shaped to maintain engagement under action of the first spring upon the trigger.

12. The trigger mechanism as claimed in claim 11, wherein each detent has an internal corner for engaging the stop on adjacent sides thereof to stop return of the trigger and release of the second member.

13. The trigger mechanism as claimed in claim 1, wherein the locking device has a pair of detents for individual engagement with a part associated with the trigger to lock the trigger, each detent being shaped to maintain engagement under action of the first spring upon the trigger.

14. The trigger mechanism as claimed in claim 13, wherein each detent has an internal corner for engaging the part associated with the trigger on adjacent sides of the trigger to stop return of the trigger and release of the locking device.

15. The trigger mechanism as claimed in claim 1, wherein the first member of the locking device is movable along a linear path in opposite directions, and the second member is pivotable by the first member, upon movements to lock the trigger.

16. The trigger mechanism as claimed in claim 15, wherein the second member of the locking device has a bifurcated end for engaging a part associated with the trigger, the bifurcated end having a gap aligned with the part when the locking device is in a central position from which the first member of the locking device is movable in the opposite directions.

17. The trigger mechanism as claimed in claim 1, wherein the first member has a part for manual operation and which is located at a position above and behind the trigger.

* * * * *